US007032341B1

(12) United States Patent
Sconce et al.

(10) Patent No.: US 7,032,341 B1
(45) Date of Patent: Apr. 25, 2006

(54) ADJUSTABLE REAR SIGHT FOR FIREARMS

(76) Inventors: Robert Sconce, 2617 County Rd. 531, Burleson, TX (US) 76028; Marvin R. Little, 270 Latimer St., Marietta, GA (US) 30008-2544; Mitch Butler, 12390 Rendon Rd., Burleson, TX (US) 76028

( * ) Notice: Subject to any disclaimer, the term of this patent is extended or adjusted under 35 U.S.C. 154(b) by 0 days.

(21) Appl. No.: 10/777,271

(22) Filed: Feb. 11, 2004

Related U.S. Application Data

(60) Provisional application No. 60/446,896, filed on Feb. 12, 2003.

(51) Int. Cl.
*F41G 1/18* (2006.01)
*F41G 1/00* (2006.01)

(52) U.S. Cl. ..... 42/111; 42/136

(58) Field of Classification Search ..... 42/111, 42/125, 136, 100–102; D22/100, 199, 108–110; 33/241–252, 260, 261
See application file for complete search history.

(56) References Cited

U.S. PATENT DOCUMENTS 1,363,553 A * 12/1920 Barringer ..... 42/145
1,438,694 A * 12/1922 Burton ..... 42/136
2,176,743 A * 10/1939 Loomis ..... 42/136
3,922,794 A * 12/1975 Ackerman, Jr. ..... 42/126
4,102,053 A * 7/1978 Colwell ..... 42/136
4,328,624 A * 5/1982 Ross ..... 42/124
D315,776 S * 3/1991 Novak ..... D22/109
5,363,559 A * 11/1994 McCarty ..... 42/122
6,016,608 A * 1/2000 Lorocco ..... 33/265
D435,283 S * 12/2000 Ling, Jr. ..... D22/109
6,295,753 B1 * 10/2001 Thummel ..... 42/116
6,481,146 B1 * 11/2002 Carrier, III ..... 42/136

OTHER PUBLICATIONS

XS Sight Systems Catalog, p. 3 XS Sight Systems, Inc., 2004.

* cited by examiner

*Primary Examiner*—Teri Pham Luu
*Assistant Examiner*—Bret Hayes
(74) *Attorney, Agent, or Firm*—Collins Law Firm, P.L.L.C.; Jeffrey N. Collins

(57) ABSTRACT

The present invention comprises a new and improved adjustable rear sight for firearms which comprises a polymer sight body and a metal aperture screw which is adjustable for elevation by screwing the aperture screw up or down in a threaded insert which is inserted in a cavity which extends from an upper surface to a lower surface of the sight body. The polymer sight is held securely in a sight mounting dovetail via a flex plate which is held to the bottom of the sight body by a flange on the bottom end of the threaded insert. The flex plate is sized to fit tightly in the sight mounting dovetail.

9 Claims, 4 Drawing Sheets

ADJUSTABLE REAR SIGHT FOR FIREARMS

Figure 1:
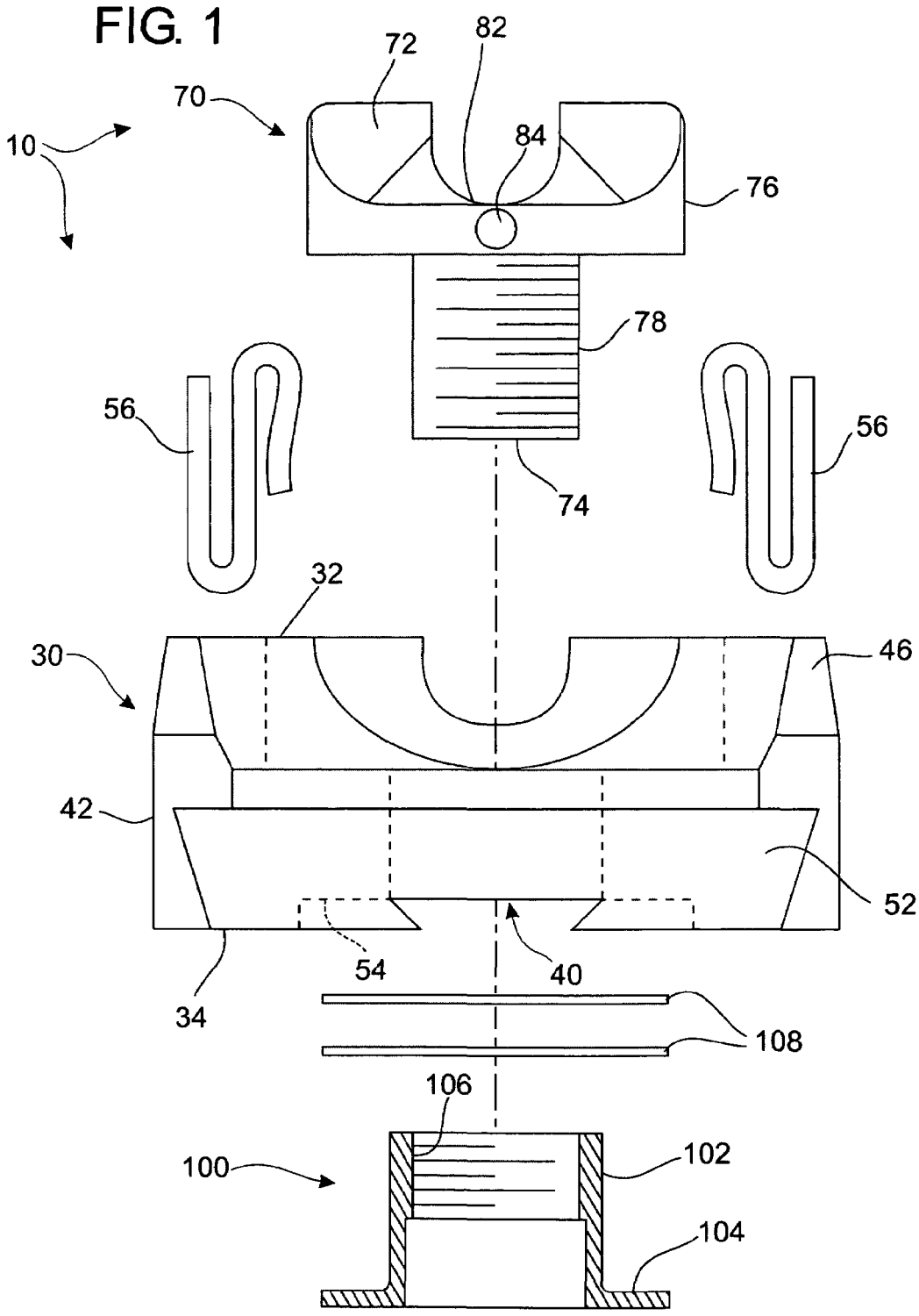

This application claims benefit of Provisional 60/446,896 filed Feb. 12, 2003.

FIELD OF THE INVENTION

In general, the present invention relates to firearms. More particularly, the present invention relates to an improved adjustable rear sight for firearms.

DESCRIPTION OF THE PRIOR ART

All firearms are equipped with some sort of sighting system to assist the shooter in aiming the weapon. There are many different sighting systems including telescopic sights, holographic sights, red dot sights, and iron sights. The term "iron sight" does not refer to the material the sight is made of but instead refers to a category of sights that consist of a rear sight located on or near the rear end of the gun closest to the shooter and a front sight located near the end of the barrel of the gun opposite the shooter. "Iron sights" may be constructed of iron, steel, aluminum, polymer or any other material of sufficient strength, rigidity and durability. The term polymer is well known to those skilled in the prior art and conveys and defines a specific class of materials when used with respect to firearms, firearm parts or accessories. The rear sight generally consists of a fixture attached to the gun that contains an aperture or a notch and the front sight generally consists of a vertical blade or post located near the end of the barrel. The shooter looks through the notch or aperture of the rear sight and centers the front sight in it. The gun is aimed by placing the front sight over the target while it is centered in the notch or aperture of the rear sight. Iron sights of both the notch and aperture variety are well known to those skilled in the prior art. Additionally, iron sights may be of the fixed or adjustable variety.

A fixed rear sight is generally constructed out of a single piece of metal plastic or polymer material. The height of the front sight must be exactly matched to the height of the rear sight in order to produce a sight picture that is the same elevation as the point of impact of the bullet. The elevation on fixed sights is set at the factory and generally can only be adjusted by exchanging the front sight for one of a different height or by filing the front sight to lower its height. Horizontal adjustments are made on fixed sights by "drifting" the sight to the left or right in its mounting dovetail. These adjustments must often be made by a skilled gunsmith. Adjustable sights are designed to allow the shooter to adjust the sight vertically and/or horizontally to bring the point of impact of the bullet in line with the sight picture on the target. Variations in ammunition, distance to the target, barrel length and other factors cause the point of impact of the bullet to shift. Adjustable sights allow the shooter to easily compensate for these variations. Sight adjustment is achieved through a variety of means from adjustment screws, to spring loaded clips, to simply sliding or "drifting" the base of the sight horizontally in a mounting dovetail.

In general, fixed sights by virtue of their simplicity tend to be more durable and less expensive than adjustable sights, which are rather complicated to manufacture and tend to be rather fragile. For those reasons, handgun manufacturers commonly utilize fixed sights for handguns intended for defensive use. One drawback of fixed sights is that the height of the front and rear sight must be matched to the particular handgun. Manufacturers who make models of the same handgun with multiple barrel length or in multiple calibers must produce or purchase a different height sight for each model of handgun they produce. This adds expense to the manufacturing process due to the need to produce additional tooling or to purchase and stock additional parts. Additionally, because ammunition used by the particular shooter may vary in velocity or bullet weight, the sights must often be adjusted by the shooter to match the ammunition used.

Thus, there is a need for an improved adjustable rear sight with improved durability, which is less complex and expensive to manufacture and assemble.

SUMMARY OF THE INVENTION

In view of the above described disadvantages inherent in the iron sights of the prior art, the improved adjustable rear firearm sight of the present invention not only allows vertical sight adjustment, but is also inherently more durable and less expensive to manufacture and assemble than other adjustable sights, due to its simplicity of design. As such, the general purpose of the present invention, which will be described subsequently in greater detail, is to provide a new and improved adjustable rear sight for a handgun or a rifle which has all of the advantages of the prior art and none of the disadvantages.

To attain this purpose, the present invention essentially comprises a sight body which is molded, formed or machined from a rigid polymer type material, or any other material of sufficient strength and rigidity, including but not limited to steel, aluminum, carbon fiber or any other like material. Inside this fixed sight body is a threaded insert into which a threaded aperture screw is installed. A sight notch is cut into the head of the aperture screw and the elevation of the aperture is adjusted by rotating the aperture screw in the threaded insert to raise or lower the height of the sight notch. In addition to a notch, the aperture could be a peep or ghostring type aperture, both of which are well known to those skilled in the prior art. Each 180 degree turn of the aperture screw raises the point of impact of the bullet an equal distance. The aperture screw adjustment is locked by spring clips which click into notches cut into the side of the aperture screw head. These notches stop the screw on every 180 degree turn and assure that the sight notch is in line with the barrel of the gun. It is also contemplated that the adjustment could be achieved via a spring loaded plunger which clicks into detents cut in the base of the aperture screw. The sight is attached to the firearm via a dovetail cut into the barrel or receiver of the firearm which receives compression washers which are placed between a flange on the threaded insert and the polymer sight body. The compression washers on the threaded insert eliminate the expense of molding a metal insert into the polymer insert to attach it to the dovetail in the gun. In addition to compression washers, other means of attachment are contemplated such as, but not limited to, a flex plate, a dovetail machined from a steel sight body, enlarging the flange on the threaded insert to fit tightly in the dovetail on the firearm, or mounting the sight to the firearm with screws.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, an object of the present invention to provide a new and improved adjustable rear sight for a handgun or a rifle which is less costly and more efficient to manufacture than the adjustable rear sights of the prior art.

It is a further object of the present invention to provide a new and improved adjustable rear sight for a handgun or a rifle that is inherently more rugged and durable.

An even further object of the present invention is to provide a new and improved adjustable rear sight for a handgun or a rifle which is less costly to assemble into the finished product.

Still another object of the present invention is to provide a new and improved adjustable rear sight for a handgun or a rifle, which reduces the number of parts, which a manufacturer must produce.

An even further object of the present invention is to provide a new and improved adjustable rear sight for a handgun or a rifle with simplified operation and fewer parts than the prior art.

These, together with other objects of the invention, along with the various features of novelty which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention

BRIEF DESCRIPTION OF THE PICTORIAL ILLUSTRATIONS AND DRAWINGS

FIG. 1 Exploded view of the improved adjustable rear sight of the present invention.

Figure 2:
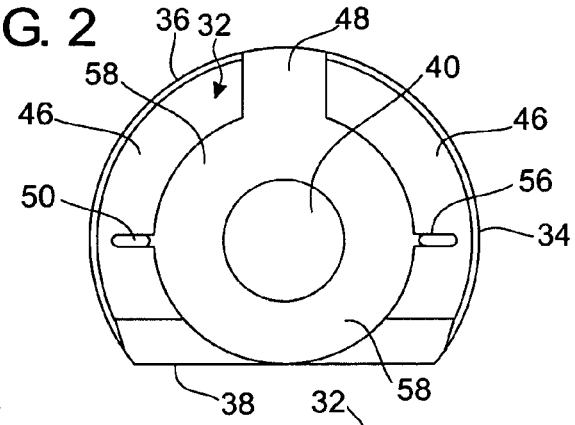

FIG. 2 Top view of the improved adjustable rear sight of the present invention.

Figure 3:
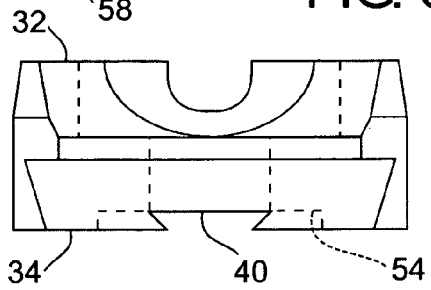

FIG. 3 Front view of the improved adjustable rear sight of the present invention.

Figure 4:
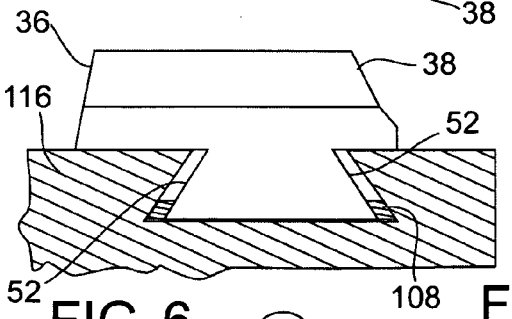

FIG. 4 Side view of the improved adjustable rear sight of the present invention.

Figure 5:
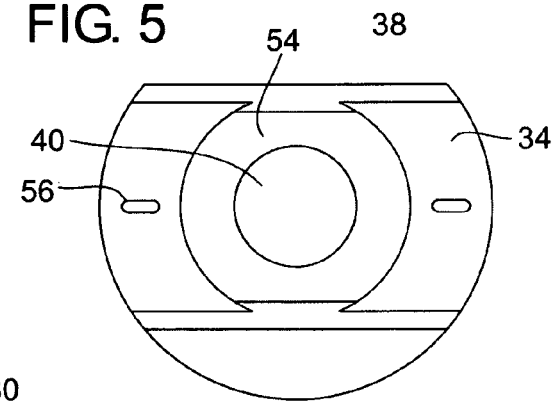

FIG. 5 Bottom view of the improved adjustable rear sight of the present invention.

Figure 6:
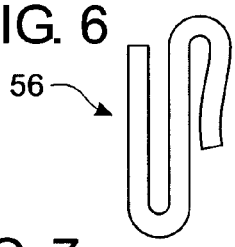

FIG. 6 Side view of the spring clip of the improved adjustable rear sight of the present invention.

Figure 7:
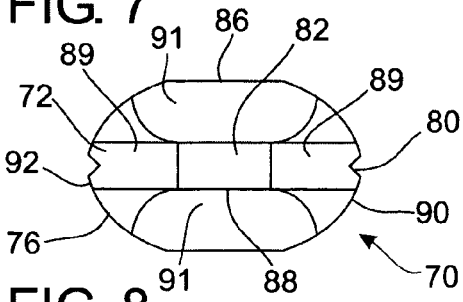

FIG. 7 Top view of the aperture screw of the improved adjustable rear sight of the present invention.

Figure 8:
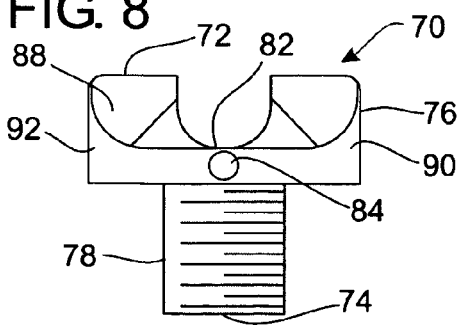

FIG. 8 Side view of the aperture screw of the improved adjustable rear sight of the present invention.

Figure 9:
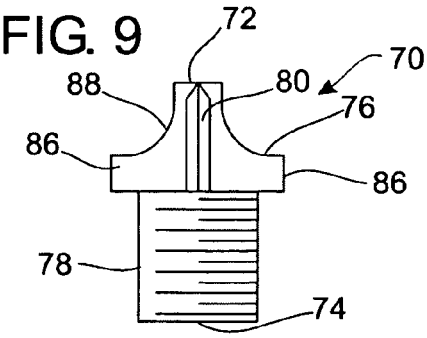

FIG. 9 Alternative side view of the aperture screw of the improved adjustable rear sight of the present invention.

Figure 10:
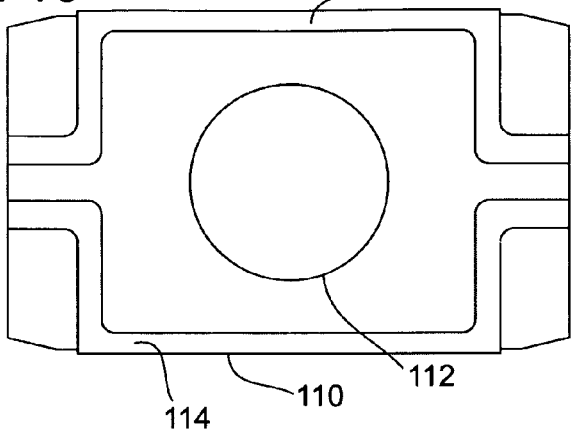

FIG. 10 Top view of the flex plate of the improved adjustable rear sight of the present invention.

Figure 11:
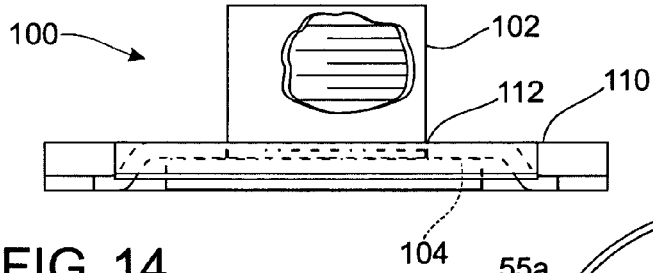

FIG. 11 Side view of the flex plate in relation to the threaded insert and a mounting dovetail.

Figure 12:
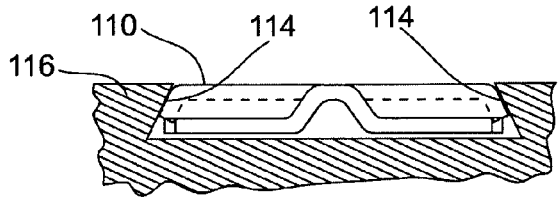

FIG. 12 Alternate side view of the flex plate of the improved adjustable rear sight of the present invention.

Figure 13:
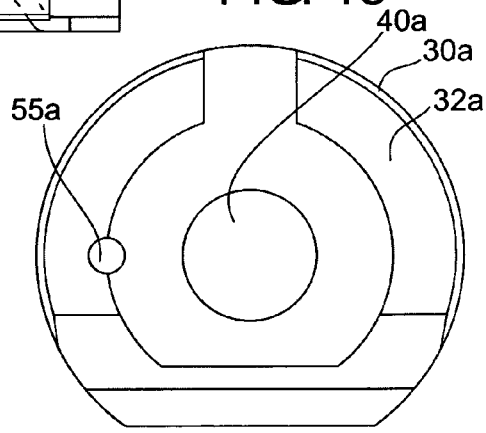

FIG. 13 A top view of an alternate embodiment of the present invention showing a sight body with a plunger cavity.

Figure 14:
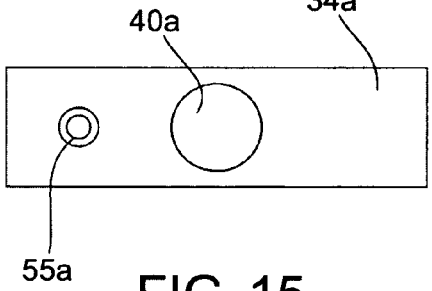

FIG. 14. A bottom view of an alternate embodiment of the present invention showing the bottom surface a sight body with a plunger cavity.

Figure 15:
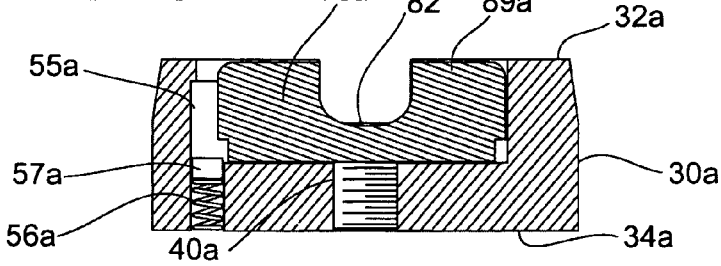

FIG. 15 A cut away view of an alternate embodiment of the present invention showing a sight body with a plunger cavity and with a spring and plunger interfacing with the aperture screw.

Figure 16:
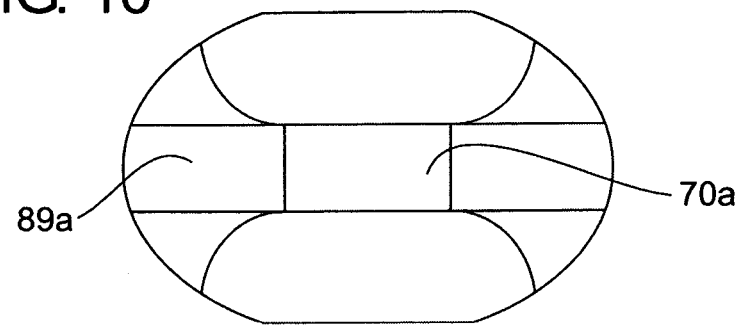

FIG. 16 A top view of an aperture screw with a plunger notch.

Figure 17:
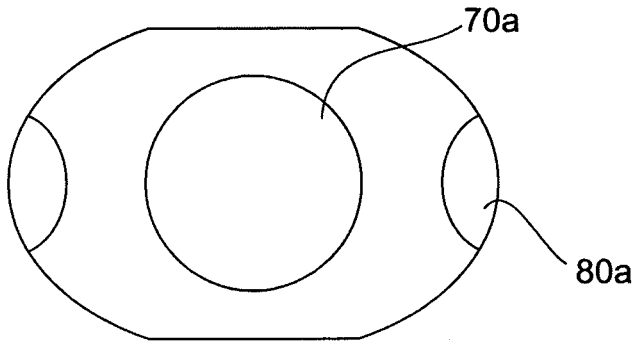

FIG. 17 A bottom view of an aperture screw with a plunger notch.

Figure 18:
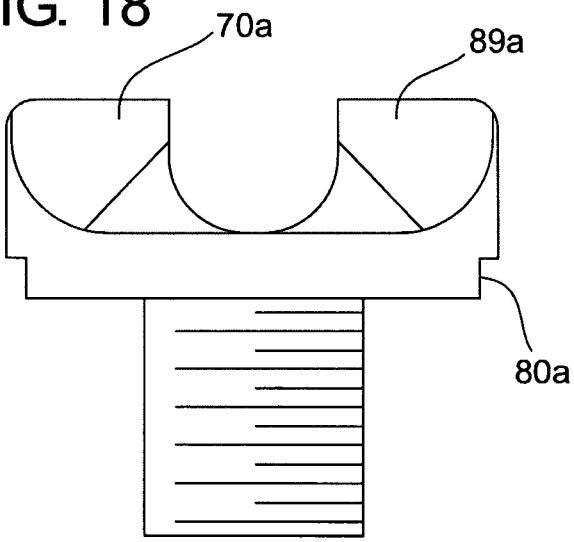

FIG. 18 A side view of an aperture screw with a plunger notch.

Figure 19:
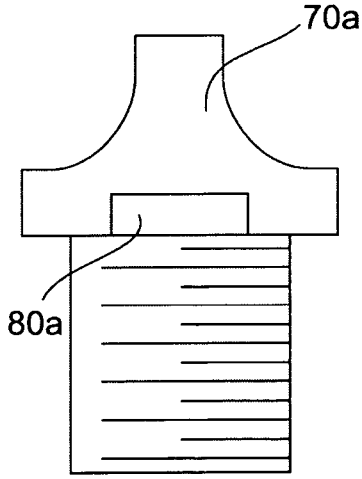

FIG. 19 An alternate side view of an aperture screw with a plunger notch.

DETAILED DESCRIPTION OF THE PREFERRED EMBODIMENTS

Referring now to FIGS. 1 and 4, a sight 10 is comprised of a sight body 30, an aperture screw 70 and a threaded insert 100. The sight body 30 is attached to a dovetail 116 cut into a firearm (not shown). The sight body 30 is formed from a material such as, but not limited to, polymer, carbon fiber, steel, aluminum, or any other material of like strength and rigidity. The sight body 30 has an upper surface 32, a lower surface 34, a first end 36, a second end 38, and a center cavity 40. Protruding above the upper surface 32 is a rim 46 that is open across the second end 38 and extends around the edge of the upper surface 32 of the sight body 30 as shown in FIG. 2. A sight opening 48 is cut into the rim 46 on the first end 36 of the sight body 30 at a position that is in line with the bore of the firearm (not shown). A spring clip recess 50 is cut on opposite sides of the rim 46 located 90 degrees from the sight opening 48. The spring clip recess 50 receives a spring clip 56.

The center cavity 40 extends from the upper surface 32 through the sight body 30 to the lower surface 34 as shown in FIG. 1. Cut into the upper surface 32 forming a radius around the center cavity 40 is an aperture screw cavity 58 as seen in FIG. 2. Cut into the lower surface 34 is a male dovetail 52. Also cut into the lower surface 34 is a flange cavity 54 shown in FIG. 5. The flange cavity 54 is circular cut around the center cavity 40. The flange cavity 54 is cut to a diameter great enough that the radius of the cavity extends sight body 30 creating an opening in the male dovetail 52 at each end. Referring now to FIG. 1, the threaded insert 100 is inserted into the center cavity 40 of the sight body 30 from the lower surface 34. The threaded insert 100, comprises a cylinder 102, and a flange 104. The cylinder 102 has a threaded inner surface 106. As seen in FIGS. 1 and 4, two flex washers 108 are deposited over the flange 104 although it is contemplated that a single compression or flex washer 108 may be utilized. The flange 104 and the flex washers 108 fit in the flange cavity 54 on the sight body 30 when the threaded insert 100 is fully inserted in the cavity 40 of the sight body 30. The flex washers 108 extend slightly beyond the male dovetail 52. The aperture screw 70 shown in FIGS. 1 and 7–9, screws down through the threaded inner surface 106 of the threaded insert 100 from the upper surface 32 of the sight body 30. The aperture screw 70 is comprised of a top end 72 and a bottom end 74 and a threaded shank 78. The aperture screw 70 has a head 76 formed on the top end 72 of the aperture screw 70. The head 76 has a first flat surface 86, a second flat surface 88, a first radius 90, and a second radius 92. The first flat surface 86 and second flat surface 88 have scallops 91 cut into them which leaves a sight plane 89 which consists of a flat surface on the top end 72 of the aperture screw 70 that extends from the first radius 90 to the second radius 92. An aperture notch 82 is cut into the center of the sight plane 89 and spring click notches 80 are cut into the head 76 of the aperture screw 70 at opposite ends of the sight plane 89. Referring now to FIG. 4, the assembled sight 10 is mounted in the female dovetail 116 of the firearm (not shown). The flex washers 108 extend slightly beyond the male dovetail 52 and, as the sight 10 is pushed into the female dovetail 116 of the firearm (not shown), the flex washers 108 compress slightly and bias the sight 10 upwards in the female dovetail 116. This upwards biasing of the sight 10 provides sufficient friction to hold the sight 10 securely in the female dovetail 116 and ensure that it is securely mounted on the firearm (not shown). Horizontal adjustment of the sight 10 is accomplished by sliding the sight 10 laterally in the female dovetail 116 to move the point of impact of the bullet (not shown) to the left or right of the shooter. Vertical adjustment of the sight 10 is accomplished by rotating the aperture screw 70 in the threaded insert 100. Each ½ turn of the aperture screw 70 raises or lowers the point of impact of the bullet (not shown) by an equal distance. The spring clips 56 clicking in the spring click notches 80 on each half turn of the aperture screw 70 accomplish alignment of the aperture screw 70 at the proper position. Additionally, the aperture screw 70 may have a tritium cavity 84 into which is placed a tritium filled glass tube (not shown) to provide illumination of the sight 70 for use at night or in low light conditions. The use of tritium to illuminate weapon sights in low light or darkness is well known to those skilled in the prior art.

An alternative embodiment of the present invention shown in FIGS. 10–12 is a flex plate 110 which may be utilized in place of the flex washers 108 as described above. The flex plate 110 is generally comprised of a stamped piece of steel or other suitable material. It has an opening 112 which fits over the cylinder 102 of the threaded insert 100 and a dovetail shoulder 114 which is dimensioned to be slightly larger than the dovetail 116. When the sight 10 is inserted into the female dovetail 116, the dovetail shoulder 114 presses against the sides of the female dovetail 116 and forces the flex plate 110 to flex upwards and bias the sight 10 in the female dovetail 116 and securely attach the sight 10 to the firearm (not shown). (Shown in FIG. 11 is a drawing of the flex plate 110 and the threaded insert 100 shown in relation to the female dovetail 116.)

Another alternative embodiment of the present invention (not shown) is the sight body 30 that is machined out of steel, aluminum, or any other suitable metal. In this embodiment the threaded insert 100, flex washers 108, and/or flex plate 110 could be eliminated and the cavity 40 could be threaded to receive the aperture screw 70. Attachment of the sight 10 to the firearm (not shown) would be accomplished via a traditional dovetail (which is well known to those skilled in the prior art) cut into the lower surface 34 of the sight body 30 of the sight 10 as illustrated in FIG. 4.

Yet another alternative embodiment of the present invention (not shown) is the threaded insert 100 which has a flange 104 which is dimensioned so that it would press against the dovetail 116 and thus eliminate the need for the use of flex washers 108 or the flex plate 110 to secure the sight 10 to the firearm (not shown).

Still another alternative embodiment of the present invention (not shown) is the sight 10 an employs the aperture screw 70 which has a peep sight or ghost ring sight (both which are well known to those who are skilled in the prior art) instead of the aperture notch 82 which was disclosed above.

Yet another embodiment of the present invention shown in FIGS. 13–19, the sight 10 utilizes a plunger 56*a* and a spring 57*a* in lieu of the spring clip 56 to provide for click stops for the vertical adjustments of an aperture screw 70*a*. The plunger 56*a* and spring 57*a* are inserted into a plunger cavity 55*a* which is drilled or cut into the lateral side of a center cavity 40*a* of a sight body 30*a*. The plunger cavity 40*a* extends from a lower surface 34*a* of the sight body 30*a* to an upper surface 32*a* of the sight body 30*a* as shown in FIG. 13. The aperture screw 70*a* has a plunger notch 80*a* cut into the base of the aperture screw 70*a* at opposite ends of a sight plane 89*a*. As the aperture screw 70*a* is turned the plunger 56*a* is biased upwards against the aperture screw 70*a* and clicks into the plunger notches 80*a* providing click stops for the vertical adjustments of the aperture screw 70*a*.

Changes may be made in the combination, operations, and arrangements of various parts and elements described herein without departing from the spirit and scope of the invention.

Parts List

| | | | |
|---|---|---|---|
| 10 - | Sight | 88 - | Second Flat Surface |
| 30 - | Sight Body | 89 - | Sight Plane |
| 32 - | Upper Surface | 90 - | First Radius |
| 34 - | Lower Surface | 91 - | Scallops |
| 36 - | First End | 92 - | Second Radius |
| 38 - | Second End | 100 - | Threaded Insert |
| 40 - | Center Cavity | 102 - | Cylinder |
| 46 - | Rim | 104 - | Flange |
| 48 - | Sight Opening | 106 - | Threaded Inner Surface |
| 50 - | Spring Clip Recess | 108 - | Flex Washers |
| 52 - | Male Dovetail | 110 - | Flex Plate |
| 54 - | Flange Cavity | 112 - | Opening |
| 56 - | Spring Clip | 114 - | Dovetail Shoulder |
| 70 - | Aperture Screw | 116 - | Female Dovetail |
| 72 - | Top End | 30a - | Sight Body |
| 74 - | Bottom End | 32a - | Upper Surface |
| 76 - | Head | 34a - | Lower Surface |
| 78 - | Threaded Shank | 40a - | Center Cavity |
| 80 - | Spring Click Notch | 55a - | Plunger Cavity |
| 82 - | Aperture Notch | 56a - | Plunger |
| 84 - | Tritium Cavity | 57a - | Spring |
| 86 - | First Flat Surface | 70a - | Aperture Screw |
| | | 80a - | Plunger Notch |
| | | 89a - | Sight Plane |

What is claimed is:

1. An adjustable rear firearm sight which comprises:

a. a sight body which is mounted on said firearm, said sight body having a center cavity, said center cavity being dimensioned to cooperate with an insert that is internally threaded;

b. a screw with an aperture for sighting said firearm, wherein said screw includes a threaded portion which engages said insert, wherein elevation adjustment is achieved by rotating said screw 180 degrees to raise or lower said aperture in equal increments, said screw having a means for providing click stops for each increment of elevation adjustment, said screw comprising a top end, a bottom end and a threaded shank, said screw having a head formed on said top end, said head having a first flat surface, a second flat surface, a first radius, and a second radius, said first flat surface and said second flat surface having scallops forming a sight plane which consists of a flat surface on said top end of said screw that extends from said first radius to said second radius and an aperture notch cut into the center of said sight plane;

c. a threaded insert which comprises a cylinder having a threaded inner surface which is dimensioned to receive said threaded shank of said screw and a flange which is dimensioned to interact with a flex plate;

said flex late having an opening which fits over said cylinder of said threaded insert and a dovetail shoulder which is dimensioned to be slightly larger than a female dovetail, when said sight, is inserted into a female dovetail of said firearm, said dovetail shoulder presses against the sides of said female dovetail, biasing said sight in said female dovetail and securely attaching said sight to said firearm.

2. The adjustable sight of claim 1, wherein said means for providing click stops comprises a spring clip inserted into a spring clip recess located on said sight body which interfaces with a spring clip notch on the opposite ends of said sight plane on said screw providing click stops for each increment of elevation adjustment of said screw.

3. The adjustable sight of claim 1, wherein said means for providing click stops comprises a plunger cavity located on a side of said center cavity of said sight body, said plunger cavity being dimensioned to accept a plunger and a spring, and said spring biasing said plunger upwards against a pair of plunger notches cut into said head of said screw at opposite ends of said sight plane, said plunger notches being dimensioned to interact with said plunger to provide click stops for each increment of elevation adjustment in said screw.

4. The adjustable sight of claim 1, wherein, a plurality of flex washers interact with said flange of said threaded insert, said flex washers being dimensioned to press against the sides of said female dovetail, biasing said sight in said female dovetail and securely attaching said sight to said firearm.

5. The adjustable sight of claim 1, wherein, said sight body is formed of polymer.

6. The adjustable sight of claim 1, wherein, said sight body is formed of steel.

7. The adjustable sight of claim 1, wherein, said sight body is formed of plastic.

8. The adjustable sight of claim 1, wherein, said sight body is formed of aluminum.

9. The adjustable sight of claim 1, wherein, said flange of said threaded insert is dimensioned to press against the sides of said female dovetail, biasing said sight in said female dovetail and securely attaching said sight to said firearm.

* * * * *